United States Patent [19]

Deryk

[11] 4,439,940

[45] Apr. 3, 1984

[54] DISPLAY BRACKET AND ATTACHMENT

[76] Inventor: George Deryk, c/o Colour Screen Pty. Ltd., 74 Wentworth Ave., Sydney, New South Wales 2000, Australia

[21] Appl. No.: 375,273

[22] PCT Filed: Aug. 25, 1981

[86] PCT No.: PCT/AU81/00121

§ 371 Date: Apr. 22, 1982

§ 102(e) Date: Apr. 22, 1982

[87] PCT Pub. No.: WO82/00578

PCT Pub. Date: Mar. 4, 1982

[30] Foreign Application Priority Data

Aug. 26, 1980 [AU] Australia ..... PE5237

[51] Int. Cl.[3] ..... G09F 3/18

[52] U.S. Cl. ..... 40/10 R; 40/124; 40/607; 40/611

[58] Field of Search ..... 40/10 R, 603, 607, 612, 40/617, 611, 10 A, 10 B, 11 R, 124, 152.1

[56] References Cited

U.S. PATENT DOCUMENTS

| | | | |
|---|---|---|---|
| 1,681,586 | 8/1928 | Kessler | 40/10 R |
| 2,652,647 | 9/1953 | Suciu | 40/10 R |
| 3,708,467 | 1/1973 | Smith et al. | 528/17 |
| 3,709,774 | 1/1973 | Kimura | 428/310.5 |
| 3,762,978 | 10/1973 | Holmes et al. | 427/322 |
| 3,783,093 | 1/1974 | Gallacher | 428/224 |
| 3,914,888 | 10/1975 | Garrison | 40/10 R |
| 3,975,849 | 8/1976 | Tuleja | 40/612 |
| 4,060,081 | 11/1977 | Yannas et al. | 128/156 |
| 4,242,817 | 1/1981 | Ballard | 40/10 D |
| 4,341,029 | 7/1982 | Heard | 40/617 |

FOREIGN PATENT DOCUMENTS

| | | | |
|---|---|---|---|
| 491464 | 3/1953 | Canada | 40/10 R |

*Primary Examiner*—Robert Peshock
*Assistant Examiner*—James Hakomaki
*Attorney, Agent, or Firm*—Kane, Dalsimer, Kane, Sullivan and Kurucz

[57] ABSTRACT

An article supporting device is disclosed having a generally triangular shape with a base, an upright side and an inclined side. The inclined side has a slot near the base into which a resilient moulded lip is snap-fitted. The lip is bendable to admit the lower edge of an article in order to nip the latter against the inclined side causing the article to stand upright. The upright side has a window for engagement with the corresponding projection of a column.

7 Claims, 4 Drawing Figures

DISPLAY BRACKET AND ATTACHMENT

The invention relates to a display bracket and attachment for the display of cards, leaflets and similar flat articles.

Although various arrangements are known for the display of cards, leaflets or the like there is a need for a simple device which can either be used for the display of individual articles or can be combined with similar devices to produce a display stand for a plurality of flat articles.

The present invention fulfils this need by providing a display bracket and attachment so designed that the bracket can be used on its own when placed on a flat surface, for example a table, to support a flat article, or can be mounted together with similar brackets by suitable attachments to a common column to form a display stand displaying articles in all directions.

According to one aspect of this invention there is provided a display bracket of substantially triangular shape comprising a base side for resting on a horizontal surface, an upright inclined side for supporting a flat display article, a clamp carried by the bracket adapted to clamp the flat display article to the inclined side, the remaining side being adapted to engage an attachment mountable on a column.

It will be appreciated that it is not necessary for the whole of the base side to contact the horizontal surface, just sufficient area for stability will suffice. In one version of the bracket the remaining side of the bracket is foreshortened such that the corner which the remaining side would otherwise make with the base side is cut off along a line substantially parallel to the inclined side to constitute a flat surface containing engagement means for the attachment. In another version, the base side is the shortest of the three sides and the remaining side is perpendicular to the base side.

The clamp may be a forwardly facing one piece moulding with a base part which engages the base side of the bracket and projects therefrom and an inclined part which in use, lies parallel to the inclined side. The inclined side of the bracket may be of shallow channel section which faces forwardly in the same direction as the clamp and the inclined part of the clamp has a rearwardly projecting lip which extends into the space defined by the channel section in order to impose a curve upon the cross-section of the flat display article rendering it sufficiently rigid to remain erect. The base part of the clamp may have a pair of rearwardly extending springy arms which terminate in detents and the base side has a forwardly facing slot which opens to the lower end of the inclined side with lateral apertures for receiving and arresting the detents when the arms are pushed into the slot. The remaining side may contain a window which receives the upstand of a L-section bracket carried by a collar attachment, the arrangement being that the clearance between the upstand and the collar just exceeds the thickness of the remaining side so that the remaining side abuts the collar and slides to a position where the top of the window abuts the well of the L-section bracket.

According to another aspect of the invention there is provided a display bracket assembly comprising (a) a display bracket of substantially triangular shape with a base side for resting on a horizontal surface, an upright inclined side for supporting a flat display article, a clamp carried by the bracket adapted to clamp a flat display article to the inclined side, the remaining side being adapted to engage an attachment mountable on a column and (b) a column-mountable attachment.

Two embodiments in the invention are now described with reference to the accompanying drawings in which FIG. 1 is a perspective view of one form of the display with a clamp shown separately;

Figure 1:
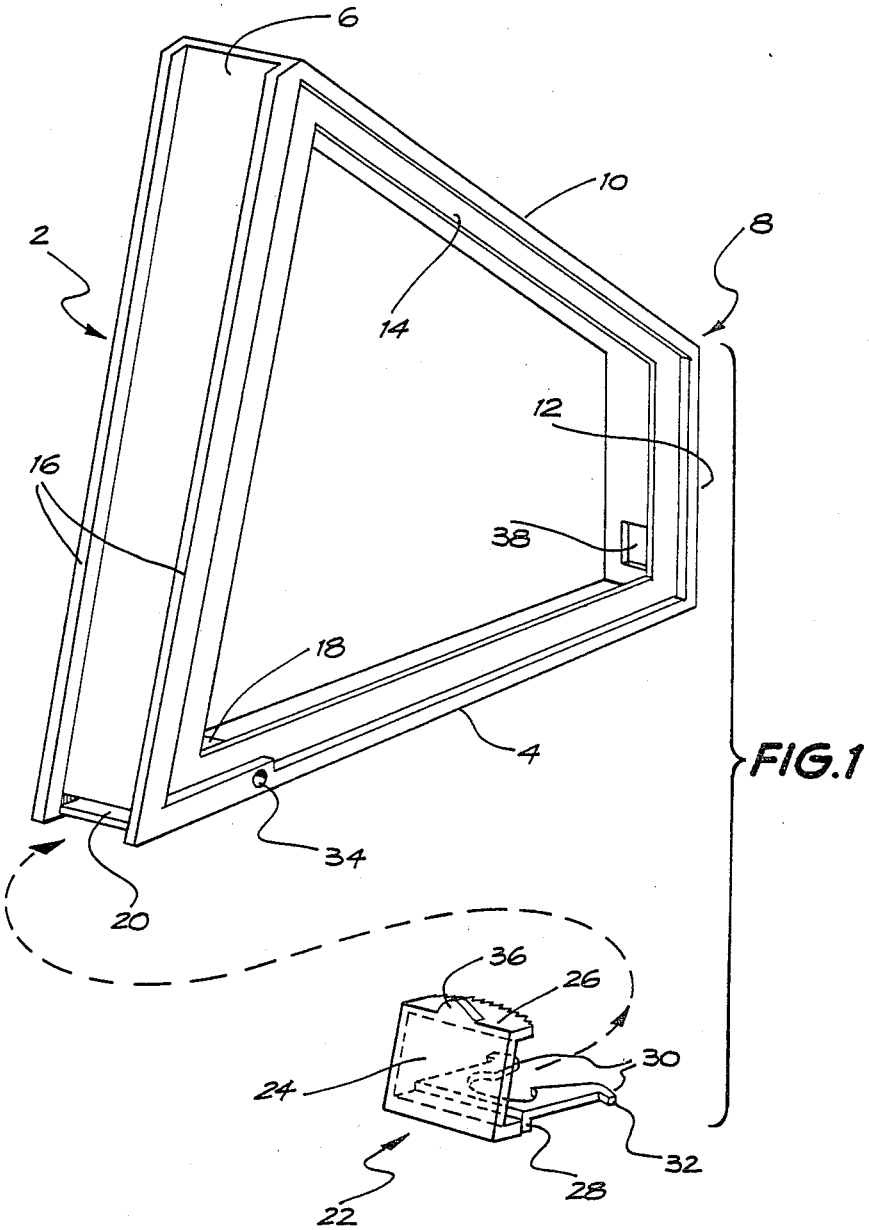
Figure 2:
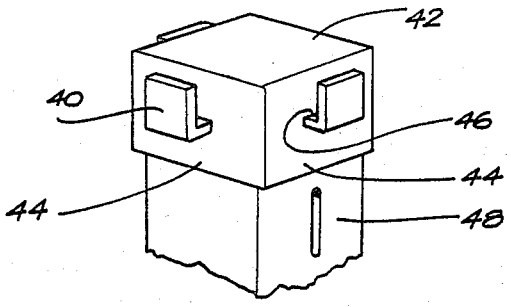
FIG. 2 is a perspective view of the column-mounted attachment.

Referring now to FIGS. 1 and 2 the triangular bracket 2 is moulded from acetal and has a base side 4, an inclined side 6, a remaining side 8 divided into a sloping portion 10 and a perpendicular portion 12 disposed at 90° to the base side. A strengthening flange 14 runs around the entire bracket. The inclined side is of shallow channel section with two parellel ribs 16 defining the sides of the channel. The corner, between the base side and the inclined side has a box 18 moulded therein which is accessible through a forwardly facing slot 20 which opens into the inclined side 6.

Figure 3:
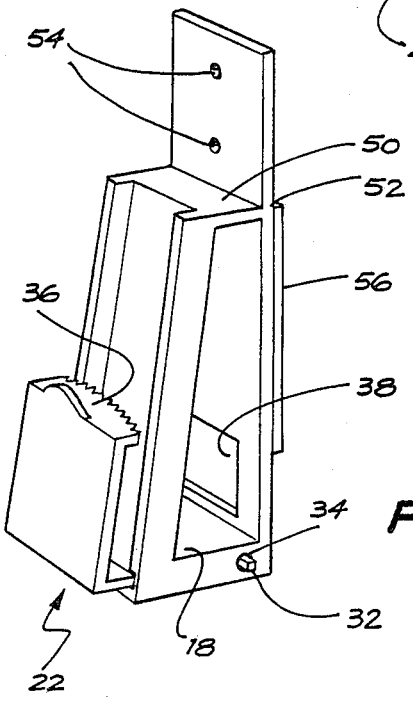
FIG. 3 is a perspective view of another form of the bracket with the clamp affixed in its working position.

The moulded plastic clamp 22 has an inclined part 24 with a rearwardly projecting arcuate, serrated lip 26 which projects into the space between ribs 16 (see FIG. 3). The base part of the clamp has a shoulder 28 which abuts the forward edge of the box 18 and a pair of springy arms 30 which terminate in outwardly directed detents 32. In use arms 30 are pushed into slot 20 until the shoulder 28 is pressed home and the detents engage apertures 34 (one shown) in the sides of box 18. A tab 36 on the inclined part allows the finger to spring the inclined part forwardly to admit the leading edge of a sheet of card or other display article which is thus pressed into a shallow curve rendering the article stiff enough to remain erect at the angle of inclination of the inclined side.

The perpendicular portion 12 has a square window 38, the purpose of which is to admit the face 40 of an L-section bracket which projects from a collar attachment 42. The clearance between the L-section bracket and the vertical surface 44 of the attachment permits the portion 12 of the display bracket to slide downwardly and rest in the well 46 of the L-section bracket. The attachment rests as a cap on top of the box section column 48.

Referring now to FIG. 3 the other version of the bracket is similar in construction except that the base side is only as long as the box 18 allowing the remaining side of the bracket to be perpendicular to the base side being connected to the inclined side by a short horizontal side 50. The remaining side containing window 38 extends above the inclined side and has a tear off incision 52, screw holes 54 and a magnetic strip 56.

Figure 4:
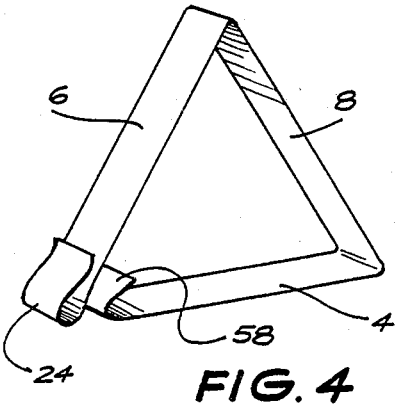
FIG. 4 is a perspective view of a one piece version.

Referring now to FIG. 4 which is about half scale the device is made of a single strip of pvc which is softened and bent in the manner shown to provide an integral clamp 24. A claw 58 can be hooked around the clamp 24 in order to overcome the inherent lack of rigidity in a one piece device made from a strip.

In other versions the attachment is not a cap but a collar fixable at any desired height on the column. It is clear that a plurality of attachments each carrying four brackets is mountable at different heights on a column. In turn the column may have a circular, triangular or otherwise shaped cross section and the attachment could be shaped accordingly.

I claim:

1. A display bracket for holding a flat display article and having a substantially trapezoidal shape comprising a base side for resting on a horizontal surface, an upright inclined side for supporting said flat display article comprising a shallow channel section which faces forwardly, in combination with a clamp carried by the bracket adapted to clamp the flat display article to the inclined side, said clamp having a rearwardly projecting flexible lip which extends into the space defined by the channel section in order to impose a curve upon the cross-section of the flat displaying article rendering it sufficiently rigid to remain erect, a rearwardly facing side being adapted to engage an attachment mountable on a column.

2. A display bracket as claimed in claim 1 wherein the clamp is a forwardly facing one piece moulding with a base part which engages the base side of the bracket and projects therefrom and an inclined part carrying said lip which in use lies parallel to the inclined side.

3. A display bracket as claimed in claim 2 wherein the base part of the clamp has a pair of rearwardly extending springy arms which terminate in detents and the base side has a forwardly facing slot which opens to the lower end of the inclined side with lateral apertures for receiving and arresting the detents when the arms are pushed into the slot.

4. A display bracket as claimed in claim 3 wherein the rearwardly facing side contains a window which receives the upstand of an L-section bracket carried by a collar attachment the arrangement being that the clearance between the upstand and the collar just exceeds the thickness of the remaining side so that the remaining side abuts the collar and slides to a position where the top of the window abuts the well of the L-section bracket.

5. A display bracket assembly comprising (a) a frame of substantially trapezoidal shape with a base side for resting on a horizontal surface an upright inclined side for supporting a thin display article (b) a clamp carried by the bracket adapted to clamp a flat display article to the inclined side a rearwardly facing side being adapted to engage an attachment mountable on a column and (c) a column-mountable attachment.

6. A one piece free-standing display device of substantially triangular shape comprising a base side for resting on a horizontal surface, an upright inclined side for supporting a flat display article, and a side connecting the base to the upright inclined side, a clamp for urging a flat display article against the upright inclined side, the clamp being formed by bending an extended foot of the upright inclined side until it overlies the lowermost part of the upright inclined side in order to define a narrow slot capable of gripping the article and the base side has a claw which is capable of being sprung over the extended foot in order to render the device more rigid.

7. A device as claimed in claim 6 when made of a single strip of thermoplastic material.

* * * * *